US007549294B2

(12) United States Patent
Buret et al.

(10) Patent No.: US 7,549,294 B2
(45) Date of Patent: Jun. 23, 2009

(54) TURBOMACHINE WITH ANGULAR AIR DELIVERY

(75) Inventors: Michel Roger Buret, Chailly en Biere (FR); Michel Pierre Cazalens, Bourron Marlotte (FR); Didier Hippolyte Hernandez, Quiers (FR)

(73) Assignee: SNECMA, Paris (FR)

( * ) Notice: Subject to any disclaimer, the term of this patent is extended or adjusted under 35 U.S.C. 154(b) by 397 days.

(21) Appl. No.: 11/484,639

(22) Filed: Jul. 12, 2006

(65) Prior Publication Data

US 2007/0012048 A1 Jan. 18, 2007

(30) Foreign Application Priority Data

Jul. 18, 2005 (FR) ..... 0507578

(51) Int. Cl.
*F02C 3/06* (2006.01)

(52) U.S. Cl. ..... 60/804; 60/752

(58) Field of Classification Search ..... 60/752, 60/796, 798, 800, 804, 751; 415/209.1
See application file for complete search history.

(56) References Cited

U.S. PATENT DOCUMENTS 4,638,628 A * 1/1987 Rice ..... 60/772
4,996,838 A 3/1991 Melconian

FOREIGN PATENT DOCUMENTS

| | | |
|---|---|---|
| DE | 1 145 438 | 3/1963 |
| DE | 195 41 303 A1 | 5/1997 |
| EP | 0 590 297 A1 | 4/1994 |
| FR | 1 173 468 | 2/1959 |

* cited by examiner

*Primary Examiner*—Michael Cuff
*Assistant Examiner*—Vikansha S Dwivedi
(74) *Attorney, Agent, or Firm*—Oblon, Spivak, McClelland, Maier & Neustadt, P.C.

(57) ABSTRACT

A turbomachine assembly comprising: an annular compression section; a casing formed by an outer annular shell (204) and an inner annular shell (206) secured inside the outer shell by means of a plurality of radial support arms (208); an annular combustion section housed inside the casing; and an annular turbine section. The air coming from the compression section presents rotary motion with an angle of inclination relative to a longitudinal axis (X-X) of the turbomachine, and the combustion section includes angular distribution means for determining air flow direction so as to impart on the gas leaving the combustion section rotary motion with an angle of inclination that is equal to or greater than the angle of inclination of the air leaving the compression section, said angular distribution means being formed by the support arms (208), each of which presents an angle of inclination relative to the longitudinal axis (X-X) of the turbomachine that is greater than or equal to the angle of inclination of the air leaving the compression section.

13 Claims, 6 Drawing Sheets

FIG.2
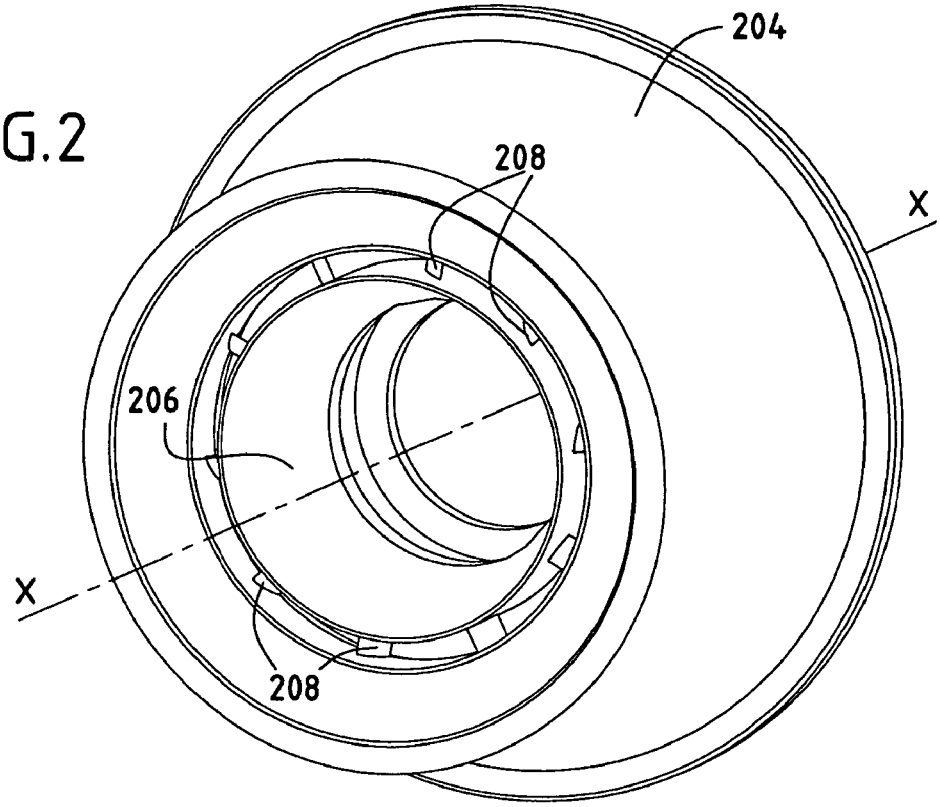
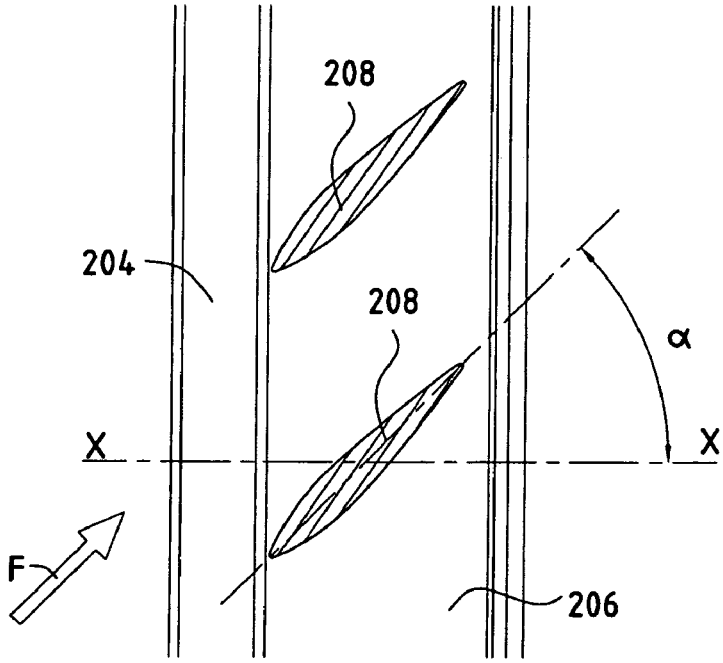
FIG.3

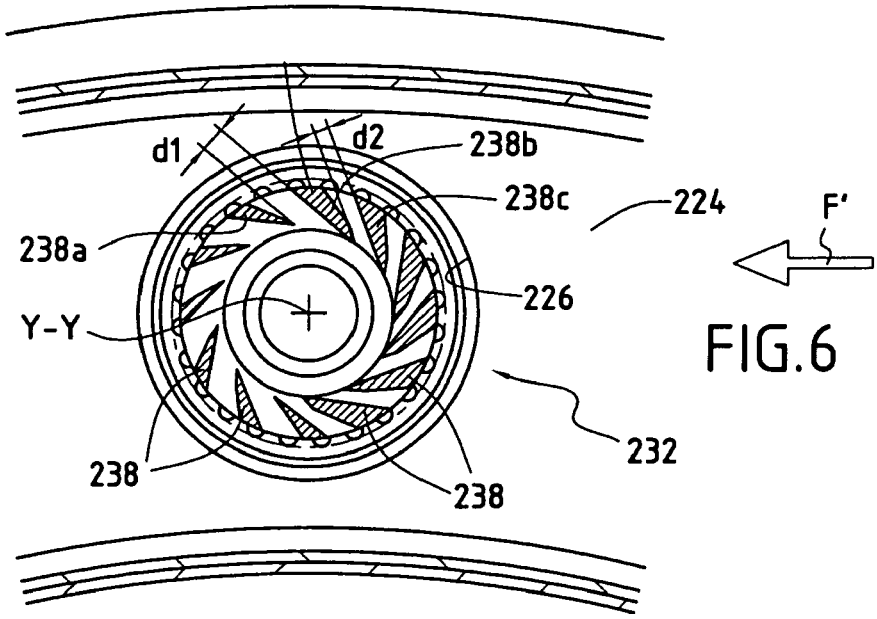
FIG.6
FIG.7
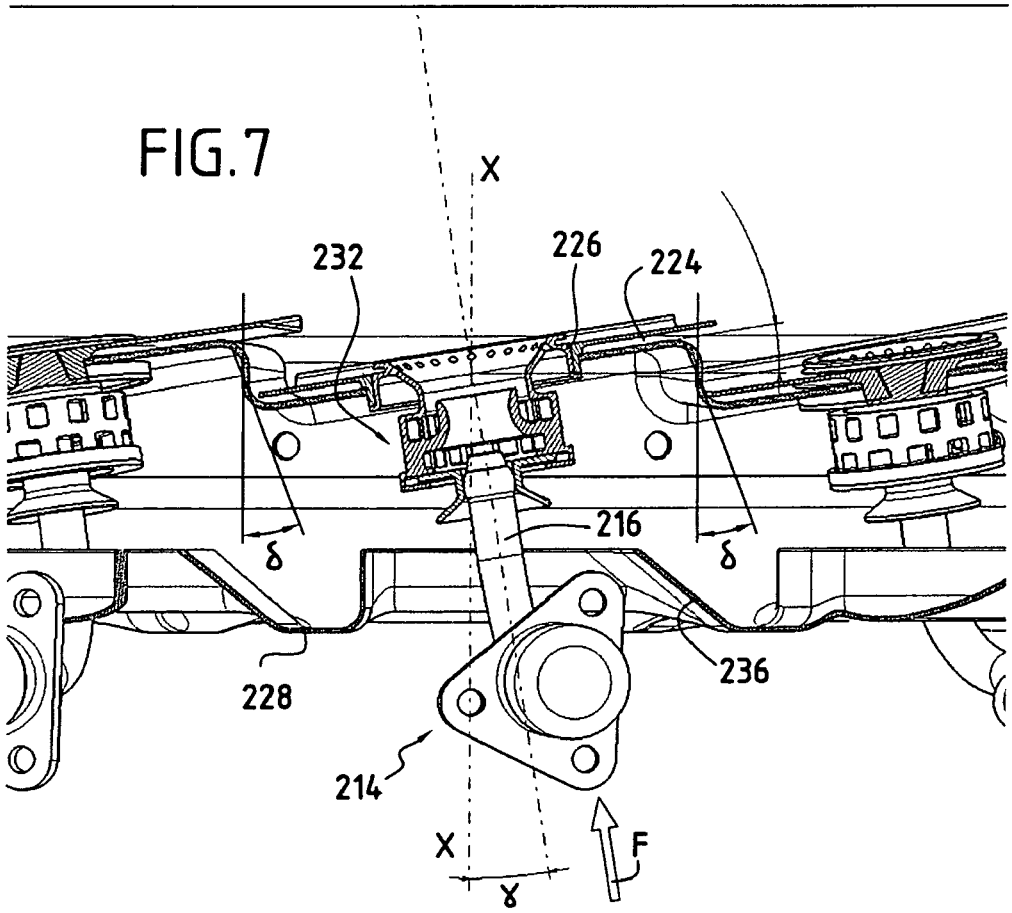

TURBOMACHINE WITH ANGULAR AIR DELIVERY

BACKGROUND OF THE INVENTION

The present invention relates to the general field of determining the flow direction of the air that passes through a turbomachine for aviation or terrestrial use.

A turbomachine is typically made up of an assembly comprising in particular an annular compression section for compressing the air that passes through the turbomachine, an annular combustion section disposed at the outlet from the compression section and within which the air coming from the compression section is mixed with fuel so as to be burnt therein, and an annular turbine section disposed at the outlet from the combustion section and having a rotor that is driven in rotation by the gas coming from the combustion section.

The compression section is in the form of a plurality of stages of moving wheels each carrying blades that are disposed in an annular channel through which the turbomachine air passes, and of section that tapers from upstream to downstream. The combustion section is likewise in the form of an annular channel, and the compressed air is mixed therein with fuel in order to be burnt. The turbine section is formed by a plurality of stages of moving wheels each carrying blades that are disposed in an annular channel through which the combustion gas passes.

The flow of air through this assembly generally takes place as follows: the compressed air coming from the last stage of the compression section possesses natural rotary motion with an angle of inclination of about 35° to 45° relative to the longitudinal axis of the turbomachine, which inclination varies as a function of the speed of rotation of the turbomachine. On entering the combustion section, the compressed air is redirected parallel to the longitudinal axis of the turbomachine (i.e. the angle of inclination of the air flow relative to the longitudinal axis of the turbomachine is returned to 0°) by means of a stator. The air in the combustion section is then mixed with fuel so as to ensure satisfactory combustion, and the gas from the combustion continues traveling generally along the longitudinal axis of the turbomachine in order to reach the turbine section. Once there, the combustion gas is redirected by a nozzle so as to present rotary motion having an angle of inclination greater than 70° relative to the longitudinal axis of the turbomachine. Such an angle of inclination is essential for producing an angle of attack suitable for providing the mechanical force for driving the moving wheel of the first stage of the turbine section in rotation.

Such angular variation in the flow direction of the air passing through the turbomachine presents numerous drawbacks. The air which naturally leaves the last stage of the compression section at an angle lying in the range 35° to 45° is successively returned to an axial direction (angle reduced to 0°) on entering the combustion section, and is then redirected to have an angle greater than 70° on entering the turbine section. These successive modifications to the angle of air flow through the turbomachine require intense aerodynamic forces to be produced by the stator in the compression section and by the nozzle in the turbine section, where such aerodynamic forces are particularly harmful to the overall efficiency of the turbomachine.

OBJECT AND SUMMARY OF THE INVENTION

A main object of the present invention is thus to mitigate such drawbacks by proposing a turbomachine in which the distribution of air flow enables a large reduction to be obtained in the successive aerodynamic forces.

To this end, the invention provides a turbomachine assembly comprising: an annular compression section for compressing air passing through said turbomachine; a turbomachine casing formed by an outer annular shell centered on a longitudinal axis of the turbomachine and an inner annular shell secured coaxially inside the outer shell by means of a plurality of radial support arms; an annular combustion section housed inside the turbomachine casing, disposed at the outlet from the compression section and within which the air coming from the compression section is mixed with fuel in order to be burnt therein; and an annular turbine section disposed at the outlet from the combustion section and having a rotor that is driven in rotation by the gas coming from the combustion section, the air coming from the compression section presenting rotary motion with an angle of inclination relative to the longitudinal axis of the turbomachine; the assembly being characterized in that the combustion section includes angular distribution means for determining air flow direction so as to impart to the gas coming from the combustion section rotary motion with an angle of inclination that is substantially equal to or greater than the angle of inclination of the air coming from the compression section, said angular distribution means being formed in the turbomachine casing by the support arms, each of which presents an angle of inclination relative to the longitudinal axis of the turbomachine that is substantially equal to or greater than the angle of inclination of the air coming from the compression section.

The invention makes it possible to conserve the natural angle of inclination of the air leaving the compression section and to maintain (or even amplify) this rotary motion of the air through the combustion section as far as the inlet to the turbine section. Thus, the aerodynamic force needed for driving the first stage of the turbine section in rotation is reduced considerably. This great reduction in aerodynamic forces leads to an increase in the efficiency of the turbomachine. Furthermore, the stator of the compression section and the nozzle of the turbine section can be simplified or even eliminated, thereby representing a saving in weight and a reduction in production costs.

The assembly may also include additional angular distribution means for determining air flow direction and formed at one or more of the following component elements of the turbomachine: a fairing of the combustion section; fuel injector systems of the combustion section; a transverse wall of the combustion section; and axial walls of the combustion section.

The present invention also provides a method of angularly distributing the flow direction of air passing through a turbomachine, the air being successively compressed by a compression section, mixed with fuel to be burnt in a combustion section, and used for setting a rotor of a turbine section into rotation, said method being characterized in that it consists in imparting to the air coming from the compression section rotary motion with an angle of inclination relative to the longitudinal axis of the turbomachine, and in maintaining or increasing this angle of inclination of the air so that the gas coming from the combustion section presents rotary motion with an angle of inclination that is substantially equal to or greater than that of the air coming from the compression section.

BRIEF DESCRIPTION OF THE DRAWINGS

Other characteristics and advantages of the present invention appear from the following description given with reference to the accompanying drawings which show an embodiment having no limiting character. In the figures:

FIG. 2 is a perspective view of the casing of the FIG. 1 turbomachine;

FIG. 3 is a developed view of support arms for the FIG. 2 casing;

FIG. 6 is a cross-section view of a system for injecting air into the combustion section of the FIG. 1 turbomachine;

FIG. 7 is a longitudinal section view of the transverse wall pierced by injection systems of the combustion section of the FIG. 1 turbomachine;

DETAILED DESCRIPTION OF AN EMBODIMENT

Figure 1:
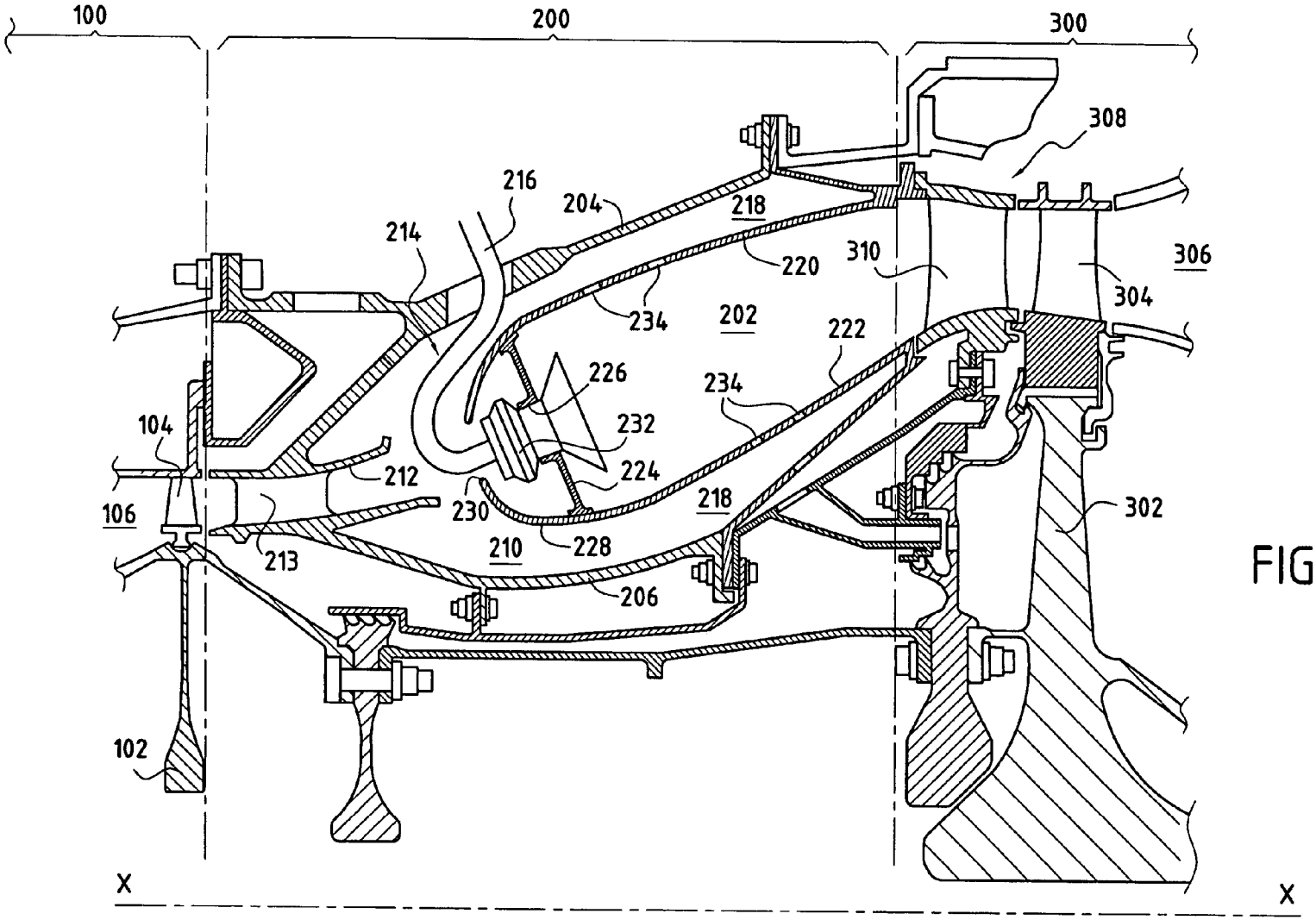
FIG. 1 is a fragmentary half-view in longitudinal section of a turbomachine of the invention.

The turbomachine shown in part in FIG. 1 has a longitudinal axis X-X. Along this axis it comprises in particular an annular compression section 100, an annular combustion section 200 located at the outlet from the compression section 100 in the flow direction of air passing through the turbomachine, and an annular turbine section 300 disposed at the outlet from the combustion section 200. The air injected into the turbomachine thus passes in succession through the compression section 100, then the combustion section 200, and finally the turbine section 300.

The compression section 100 is in the form of a plurality of stages of moving wheels 102 each carrying blades 104 (only the last stage of the compression section is shown in FIG. 1). The blades 104 of these stages are disposed in an annular channel 106 through which the turbomachine air passes and of section that tapers from upstream to downstream. Thus, as the air injected into the turbomachine passes through the compression section, it becomes more and more compressed.

The combustion section 200 is likewise in the form of an annular channel in which the compressed air coming from the compression section 100 is mixed with fuel in order to be burnt therein. For this purpose, the combustion section has a combustion chamber 202 within which the air-and-fuel mixture is burnt.

The combustion section 200 includes a turbomachine casing formed by an outer annular shell 204 centered on the longitudinal axis X-X of the turbomachine, and an inner annular shell 206 secured coaxially inside the outer shell by a plurality of arms 208 disposed radially relative to the longitudinal axis X-X of the turbomachine and spaced apart regularly around the entire circumference of the casing (FIG. 2). An annular space 210 formed between these two shells 204, 206 receives the compressed air coming from the compression section 100 of the turbomachine via an annular diffusion duct 212.

The arms 208 in the diffusion duct 212 have two main functions: the first is mechanical (interconnecting the outer shell 204 and the inner shell 206 of the casing); and the other is to form a stator 213 for imparting a selected rotary motion to the air leaving the compression section 100.

A plurality of fuel injector systems 214 are regularly distributed around the diffusion duct 212 and open out into the annular space 210. Each of these injection systems is provided with a fuel injector nozzle 216 secured to the outer shell 204 of the casing.

The combustion chamber 202 is mounted inside the annular space 210 so as to co-operate with the outer and inner shells 204 and 206 to form an annular channel 218 for receiving a flow of dilution and cooling air (also referred to as air bypassing the combustion chamber).

The combustion chamber 202 is of the annular type; it is constituted in particular by an outer annular wall 220 centered on the longitudinal axis X-X of the turbomachine and secured to the outer shell 204 of the casing, and by an inner annular wall 222 coaxial with the outer wall 220 and secured to the inner shell 206 of the casing.

At their upstream ends, the outer and inner walls 220 and 222 are interconnected by a transverse wall 224 forming a chamber end wall. This chamber end wall 224 is provided with a plurality of openings 226 through which the fuel injector systems 214 pass.

The combustion chamber 202 also includes an annular fairing 228 mounted on the chamber end wall 224 so as to extend the axial walls 220, 222 of the chamber. This fairing 228 presents a plurality of openings 230 through which the fuel injector systems 214 pass.

Fuel is injected into the combustion chamber 202 by the fuel injector systems 214. The air which mixes with the fuel in the combustion chamber comes firstly from injection systems, each of which is provided at one end with an air swirling bowl 232, and secondly from the air that bypasses the combustion chamber and flows through orifices 234 formed through the axial walls 220 and 222 of the chamber. Within the combustion chamber, the air-and-fuel mixture that has been introduced in this way is burnt so as to form combustion gas.

The turbine section 300 of the turbomachine is formed by a plurality of stages of moving wheels 302 each carrying blades 304 (only the first stage of the turbine section is shown in FIG. 1). The blades 304 of these stages are disposed in an annular channel 306 through which the gas coming from the combustion section 200 passes.

On entering the first stage 302 of the turbine section 300, the gas from the combustion section must present an angle of inclination relative to the longitudinal axis X-X of the turbomachine that is sufficient to drive the various stages of the turbine section in rotation.

For this purpose, a nozzle 308 is mounted directly downstream from the combustion chamber 202 and upstream from the first stage 302 of the turbine section 300. This nozzle 308 is made up of a plurality of stationary radial vanes 310, each at an angle of inclination relative to the longitudinal axis X-X of the turbomachine that serves to impart to the gas coming from the combustion section 200 the angle of inclination that is needed for driving the various stages of the turbine section in rotation.

In conventional turbomachines, the flow direction of the air passing successively through the compression section 100, the combustion section 200, and the turbine section 300 is distributed as follows. The compressed air coming from the last stage 102 of the compression section 100 naturally possesses rotary motion with an angle of inclination of about 35° to 45° relative to the longitudinal axis X-X of the turbomachine. The stator 213 in the combustion section 200 serves to bring this angle of inclination down to 0°. Finally, at the inlet of the turbine section 300, the gas coming from the combustion section is redirected by the nozzle 308 thereof so as to impart rotary motion thereto with an angle of inclination relative to the longitudinal axis X-X that is greater than 70°.

According to the invention, angular distribution means are provided for determining air flow direction so as to maintain or even increase the natural angle of inclination of the air coming from the compression section 100 so that the gas coming from the combustion section 200 presents rotary motion with an angle of inclination that is substantially equal to or greater than that of the air coming from the compression section.

Maintaining or even increasing the angle of inclination of the compressed air from the outlet of the compression section 100 as far as the inlet to the turbine section 300 presents numerous advantages.

In particular, it is no longer necessary for the nozzle 308 of the turbine section 300 to present such a large angle of inclination (at least 70° in conventional turbomachines) in order to produce the angle of attack needed to deliver the mechanical force for driving the moving wheel 302 of the first stage turbine section in rotation. Depending on the angle of inclination obtained at the outlet from the combustion section by the angular distribution means, the angle of inclination of the nozzle 308 serves solely to compensate for the difference between the angle of inclination of the combustion gas that already presents rotary motion and the angle of attack required for imparting rotary motion to the first stage 302 of the turbine section.

If the angular distribution means enable an angle of inclination to be obtained at the outlet from the combustion section that is equal to the angle of attack needed for setting the first stage 302 of the turbine section into rotation, then the nozzle 308 can even be omitted, which represents a major saving in weight, bulk, and manufacturing costs for the turbomachine. Similarly, by optimizing the angular distribution means, the function of the stator 213 in the combustion section 200 can be omitted and all that needs to be retained is the mechanical function of the arms 208, likewise presenting the advantage of reducing the weight and the bulk of the turbomachine, and reducing its production costs. Furthermore, the aerodynamic force needed for driving the first stage 302 of the turbine section 300 in rotation is considerably reduced, thereby leading to a significant improvement in terms of the efficiency of the turbomachine.

The angular distribution means of the invention can be formed at one or more of the component elements of the turbomachine as described below. It should be observed that the modifications made to these component elements of the turbomachine can be combined with one another in order to optimize the distribution of air flow angle so that the gas at the outlet from the combustion section presents an angle of inclination that is equal to (or as close as possible to) the angle of attack needed for setting the first stage of the turbine section into rotation.

Modification to the Casing of the Combustion Section

This modification is shown in FIGS. 2 and 3. FIG. 2 shows the casing of the turbomachine as formed by the outer shell 204 and the inner shell 206 and having the combustion chamber (not shown) mounted therebetween.

According to the invention, the arms 208 that continue to be necessary in order to hold the inner shell 206 inside the outer shell 204 are each inclined at an angle $\alpha$ relative to the longitudinal axis X-X of the turbomachine. This angle of inclination $\alpha$ is substantially equal to or greater than the angle of inclination of the air coming from the compression section.

By way of example, if the air coming from the compression section flows in a general direction F presenting rotary motion with an angle of inclination of about 35° to 45° relative to the longitudinal axis X-X, the angle of inclination $\alpha$ of the support arms 208 should be at least 35°.

In a variant that is not shown in the figures, it is possible to envisage each of the support arms 208 presenting a profile of the same type as a moving blade of a gas turbine with a general angle of inclination not less than that of the air coming from the compression section, or even greater than said angle in order to impart an additional rotary effect.

Modification to the Fairing of the Combustion Section

Figure 4:
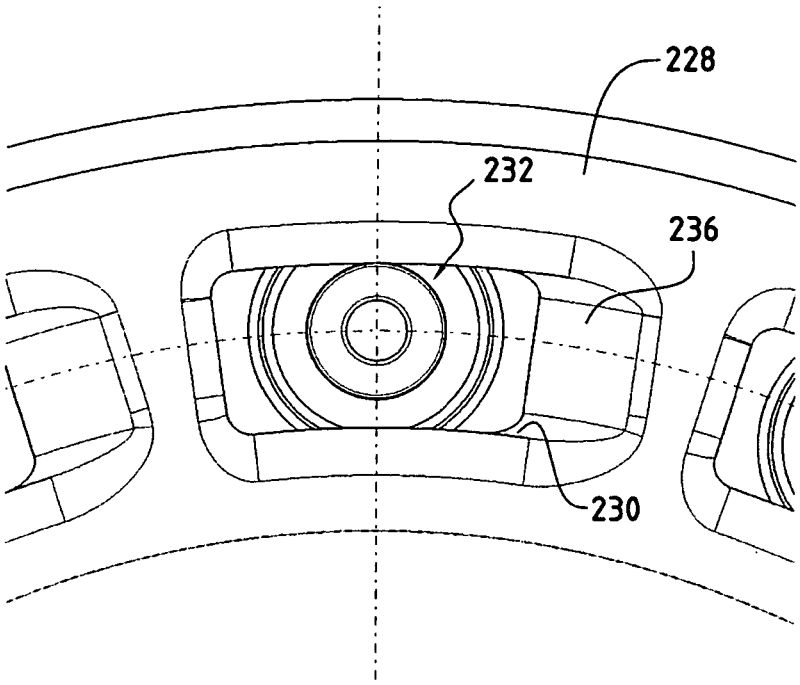
FIG. 4 is a face view of the fairing of the combustion section of the FIG. 1 turbomachine.
Figure 5:
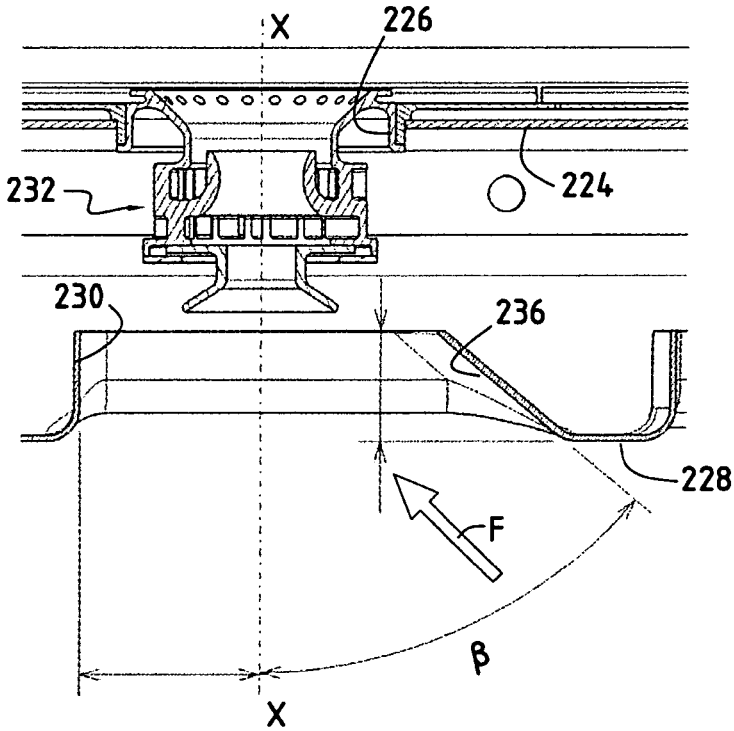
FIG. 5 is a longitudinal section of the FIG. 4 casing.

This modification is shown in FIGS. 4 and 5. These figures show a portion of the annular fairing 228 mounted on the end wall of the combustion chamber to extend the axial walls thereof.

As described above, the fairing 228 is provided with a plurality of openings 230 for passing fuel injector systems (for simplification purposes, only the air-swirler bowl 232 of the fuel injector system is shown in FIGS. 4 and 5).

According to the invention, each opening 230 in the fairing 228 has an axial wall 236 forming an angle of inclination $\beta$ relative to the longitudinal axis X-X of the turbomachine, which angle is substantially equal to or greater than the angle of inclination of the air coming from the compression section.

For example, when the air coming from the compression section flows in a general direction F having an angle of inclination of about 35° to 45°, the angle of inclination $\beta$ of the axial wall 236 of each opening 230 in the fairing 228 should be at least 35°.

It should be observed that if the above-described modification is applied to the support arms of the casing so that they have an angle of inclination greater than that of the air coming from the compression section, then the angle of inclination $\beta$ of the axial wall 236 of each opening 230 in the fairing 228 is preferably equal to or greater than said angle of inclination of the support arms.

Modification to the Injector Systems of the Combustion Section

A first embodiment of this modification is shown in FIG. 6, which is a cross-section through a bowl 232 of a fuel injector system passing through an opening 226 formed in the end wall 224 of the combustion chamber.

The bowl 232 of each fuel injector system is provided with a plurality of air swirlers 238 disposed radially relative to a longitudinal axis Y-Y of the bowl parallel to the longitudinal axis of the turbomachine (not shown). The air swirlers 238 serve to impart rotary motion to the air introduced into the combustion chamber via the bowls of the fuel injector systems. They can be arranged in one or two stages.

According to the invention, the air swirlers 238 of the bowl 232 of each fuel injector system present varying permeability to air so as to obtain uniform air feed. The term "varying permeability" means that the air flow section between the swirlers varies depending on the angular position of each swirler.

This modification is made necessary because the air coming from the compression section presents rotary motion, which means that the upstream portions of the air swirlers (upstream relative to the direction of rotation of the air feeding the swirlers) are fed more favorably with air than are the downstream portions.

Preferably, the varying permeability of the air swirlers 238 in each bowl 232 is obtained by varying the spacing between the swirlers depending on the angle of inclination of the air coming from the compression section.

For example, for a rotary flow of air coming from the compression section along a general direction F, shown in projection as F' in FIG. 6, the spacing dl between adjacent air swirlers 238*a* and 238*b* is greater than the spacing d2 between adjacent air swirlers 238*b* and 238*c*.

FIG. 7 shows an alternative embodiment of the modification applied to the fuel injector systems.

In this embodiment, the fuel injector systems 214 (i.e. the assemblies each comprising an injector nozzle 216 and an air swirler bowl 232) are each disposed at an angle of inclination γ relative to the longitudinal axis X-X of the turbomachine, where the angle γ is substantially equal to or greater than the angle of inclination of the air coming from the compression section.

Still with the example of air coming from the compression section flowing in a general direction F that presents an angle of inclination of about 35° to 45°, the angle of inclination γ of the fuel injector systems 214 should be not less than 35°. This angle of inclination γ could even be greater, in particular if the modifications are also made to the casing support arms and/or to the fairing of the combustion section.

Modification to the End Wall of the Combustion Chamber

Figure 8:
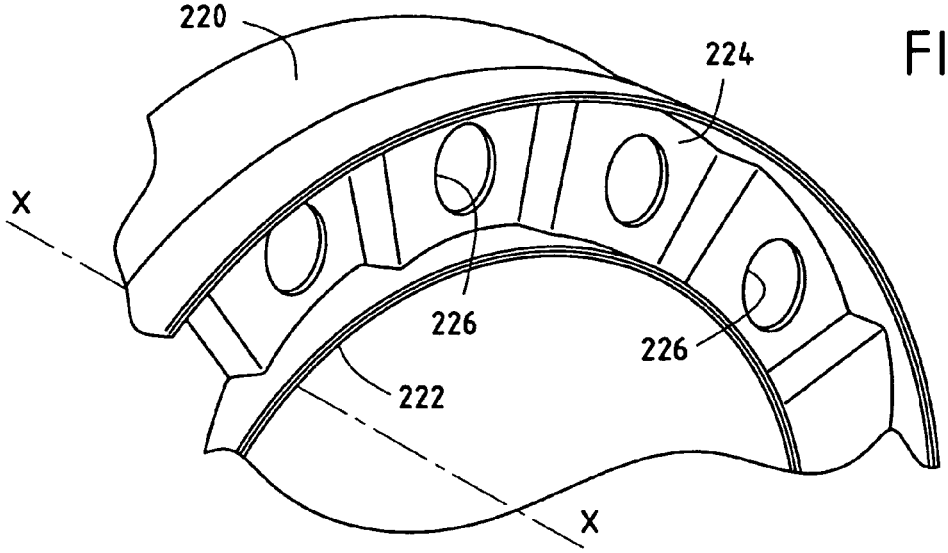
FIG. 8 is a fragmentary, perspective view of the transverse wall of the combustion chamber of the FIG. 1 turbomachine.

This modification is shown in FIGS. 7 and 8 showing in particular the end wall 224 of the combustion chamber, i.e. the transverse wall interconnecting the upstream ends of the axial walls 220 and 222 of the combustion chamber.

According to the invention, the end wall 224 at each fuel injector system 214 presents an angle of inclination δ relative to a transverse plane P of the turbomachine (i.e. relative to a plane P perpendicular to the longitudinal axis X-X of the turbomachine).

Such a characteristic consists in modifying the end wall 224 of the combustion chamber so that it presents a "staircase" shape, with each step therein being associated with a respective fuel injector system 214. This shape can be seen particularly clearly in FIG. 8.

When each fuel injector system 214 presents an angle of inclination γ relative to the longitudinal axis X-X as proposed above (FIG. 7), the angle of inclination δ of the chamber end wall 224 is preferably substantially identical to the angle of inclination of the injector system.

Modification to the Axial Walls of the Combustion Section

As described above with reference to FIG. 1, orifices 234 are formed through the axial walls 220 and 222 of the combustion chamber 202 in order to pass air needed for combustion and for diluting the air-and-fuel mixture.

The axial walls 220 and 222 of the combustion chamber 202 are also provided with a plurality of additional passages for air. The air passing through these passages serves to cool the axial walls of the combustion chamber by forming air films on their inside surfaces (the chamber walls are then said to be cooled by "multiperforation").

Such cooling air passages generally consist of orifices pierced through the thickness of the axial walls of the combustion chamber so as to form channels. These orifices can be pierced either perpendicularly to the axial walls, or else so as to be inclined relative thereto. Furthermore, these orifices are distributed in an array over the surfaces of the axial walls 220 and 222 of the combustion chamber.

Figure 9:
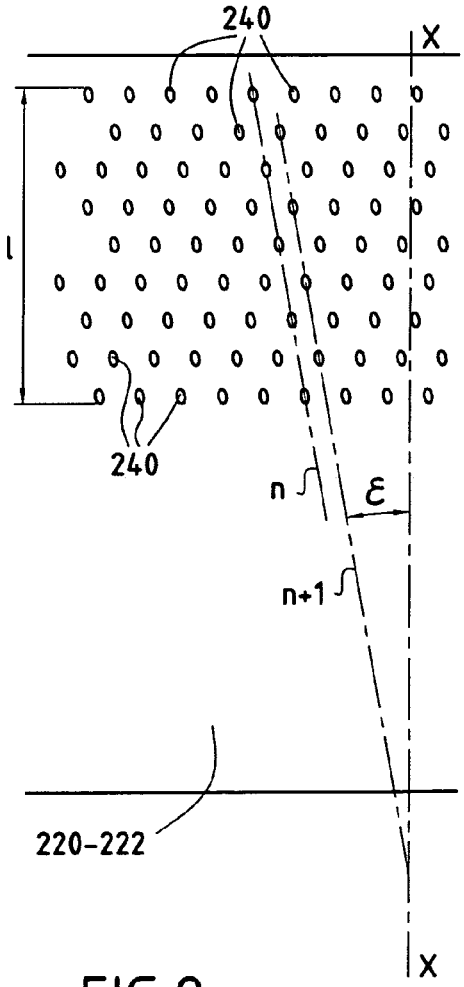
FIG. 9 is a developed view of an axial wall of the combustion chamber of the FIG. 1 turbomachine.

FIG. 9 shows a modification applied to orifices pierced through the thickness of the axial walls 220 and 222 oft the combustion chamber in one embodiment of the invention.

In the embodiment shown in FIG. 9, the orifices 240 pierced through the axial walls 220 and 222 are distributed in an array extending over an axial length l. Within the array, the orifices 240 are aligned in parallel rows. As shown for rows n and n+1, the orifices of two adjacent rows may also be disposed in a staggered configuration.

According to the invention, each of these rows of orifices 240 presents an angle of inclination ϵ relative to the longitudinal axis X-X of the turbomachine that is substantially equal to or greater than the angle of inclination of the air coming from the combustion section.

The angle of inclination ϵ may be greater than that of the air coming from the compression section, particularly if the modifications described above to the casing support arms and/or to the combustion section and/or to the fuel injection systems have also been applied.

In a variant embodiment that is not shown in the figures, the profiles of the rows of orifices for passing cooling air can be curved, i.e. the angle of inclination of each row relative to the longitudinal axis of the turbomachine can increase with increasing distance from the inlet of the combustion chamber.

Figure 10A:
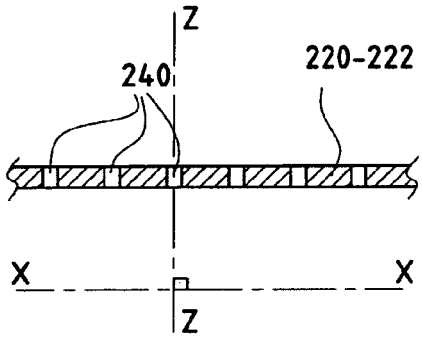
FIGS. 10A and 10B are cross-section views of the axial wall of the combustion chamber of the FIG. 1 turbomachine in various embodiments.

Furthermore, as shown in FIG. 10A, the orifices may be pierced through the thickness of the axial walls 220 and 222 of the combustion chamber so as to form channels 240 perpendicular thereto (i.e. the channels 240 are parallel to an axis Z-Z perpendicular to the walls).

Figure 10B:
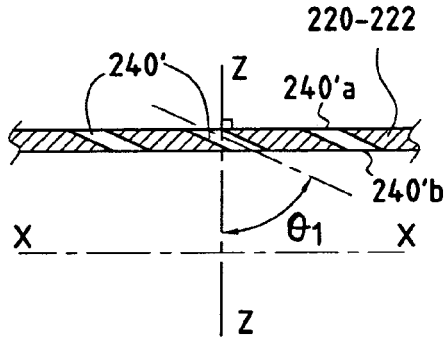

Alternatively, as shown in FIG. 10B, the orifices may be in the form of channels 240' each having an angle of inclination θ1 relative to an axis Z-Z perpendicular to the walls, where the angle of inclination θ1 is preferably directed in such a manner that the orifices are inclined towards the downstream end of the combustion chamber.

Figure 11A:
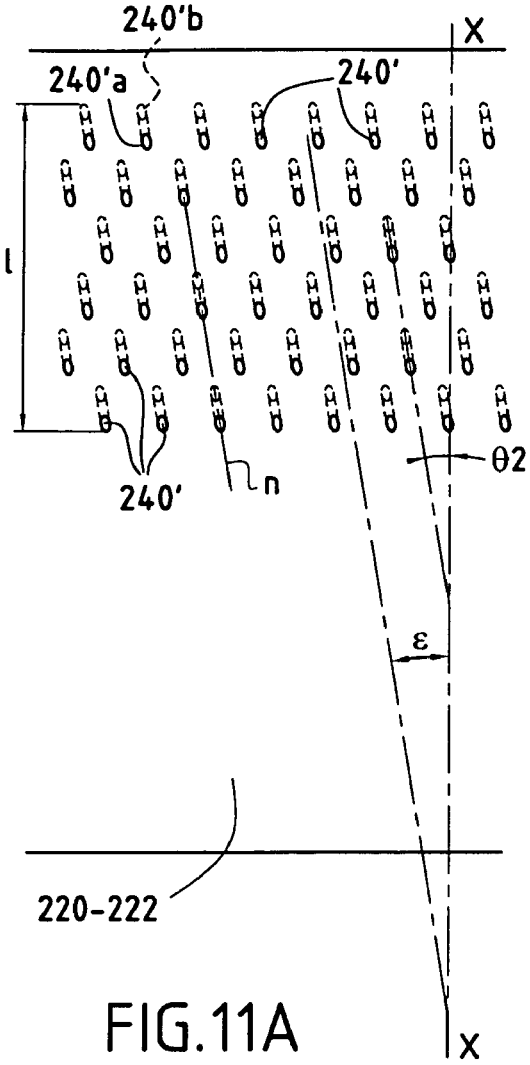
FIGS. 11A and 11B are developed views of an axial wall of the combustion chamber of the FIG. 1 turbomachine in various embodiments of the invention.
Figure 11B:
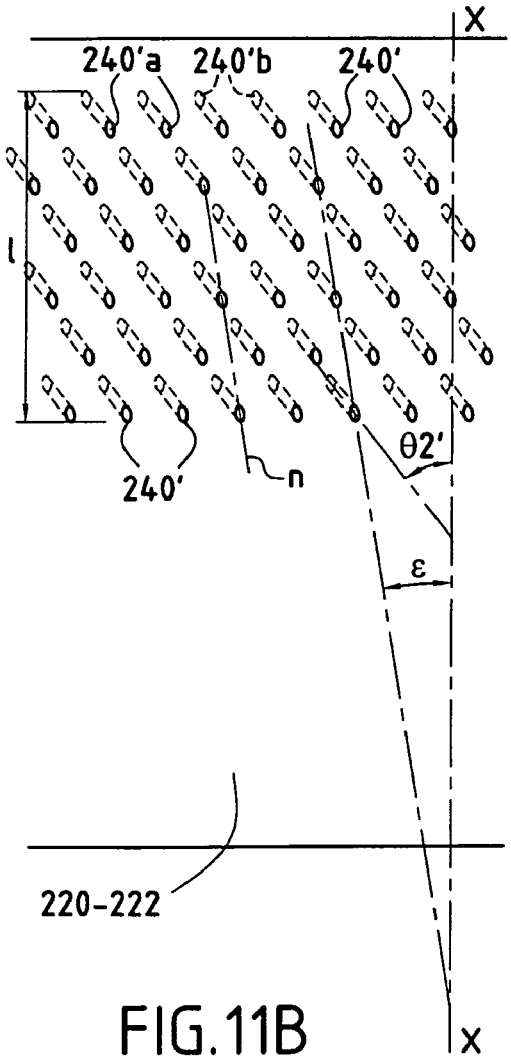

FIGS. 11A and 11B show variant embodiments in which each of the channels 240' pierced through the axial walls 220 and 222 of the combustion chamber presents such an angle of inclination θ1 relative to an axis perpendicular to the walls.

In the embodiment of FIG. 11A, the orifices 240' are distributed in the form of an array extending over an axial length l and within which they are aligned in parallel rows n, each row of orifices presenting an angle of inclination ϵ relative to the longitudinal axis X-X of the turbomachine as described above.

Each channel 240' that presents an angle of inclination θ1 is situated in a plane perpendicular to the walls 220 and 222 of the combustion chamber. This plane perpendicular to the walls in which each channel 240' is situated, itself also presents an angle of inclination θ2 relative to the longitudinal axis X-X of the turbomachine. This angle of inclination θ2 is implemented so as to coincide with the angle of inclination ϵ of the rows n of orifices. In other words, the axis passing through the air inlet and outlet holes 240'*a* and 240'*b* of each channel 240' lies in a plane perpendicular to the walls 220 and 222 that is in alignment with the alignment axis of said rows n of orifices.

In the embodiment of FIG. 11B, the orifices 240' are likewise distributed in the form of an array extending over an axial length l within which they are aligned in parallel rows n, each row of orifices presenting an angle of inclination ϵ relative to the longitudinal axis X-X of the turbomachine as described above.

Each channel 240' presenting an angle of inclination θ1 is also situated in a plane perpendicular to the walls 220 and 222 of the combustion chamber. In addition, this plane perpendicular to the walls in which each channel 240' is situated, itself presents an angle of inclination θ2, relative to the longitudinal axis X-X of the turbomachine.

Unlike the embodiment of FIG. 11A, this angle of inclination θ2' is perceptibly greater than the angle of inclination ϵ of the rows n of orifices, and it is implemented in such a manner as to impart to the air leaving these channels additional rotation relative to the longitudinal axis X-X of the turbomachine. In other words, the axis passing through the inlet and outlet holes 240'*a* and 240'*b* of each channel 240' lies in a plane perpendicular to the walls 220 and 222 that is inclined at an angle ($\theta$2'$-\epsilon$) relative to the alignment axis of each row n of orifices.

In addition, the angle of inclination $\theta$2' of the plane perpendicular to the axial walls 220 and 222 of the combustion chamber in which the channels 240' are situated lies in a range of values situated between $\epsilon$ and $\epsilon+90°$ relative to the longitudinal axis X-X of the turbomachine.

Furthermore, in a variant embodiment that is not shown in the figures, the profiles of the rows of these channels 240' for passing cooling air can themselves be curved, i.e. the angle of inclination $\theta$2' of the plane perpendicular to the axial walls of the combustion chamber in which each channel in these rows is situated can vary with increasing distance from the inlet to the combustion chamber.

The invention claimed is:

1. A turbomachine assembly comprising:

an annular compression section for compressing air passing through said turbomachine;

a turbomachine casing formed by an outer annular shell centered on a longitudinal axis (X-X) of the turbomachine and an inner annular shell secured coaxially inside the outer shell by a plurality of radial support arms;

an annular combustion section housed inside the turbomachine casing, disposed at the outlet from the compression section and within which the air coming from the compression section is mixed with fuel in order to be burnt therein; and an annular turbine section disposed at the outlet from the combustion section and having a plurality of moving wheels that are driven in rotation by the gas coming from the combustion section, the air coming from the compression section presenting rotary motion with an angle of inclination relative to the longitudinal axis (X-X) of the turbomachine;

wherein each of the support arms presents an angle of inclination ($\alpha$) relative to the longitudinal axis (X-X) of the turbomachine that is substantially equal to or greater than the angle of inclination of the air coming from the compression section so as to impart to the gas coming from the combustion section rotary motion with an angle of inclination that is substantially equal to or greater than the angle of inclination of the air coming from the compression section.

2. An assembly according to claim 1, further comprising additional angular distribution means for determining air flow direction and formed at one or more of the following component elements of the turbomachine: a fairing of the combustion section; fuel injector systems of the combustion section; a transverse wall of the combustion section; and axial walls of the combustion section.

3. A turbomachine assembly comprising:

an annular compression section for compressing air passing through said turbomachine;

a turbomachine casing formed by an outer annular shell centered on a longitudinal axis (X-X) of the turbomachine and an inner annular shell secured coaxially inside the outer shell by a plurality of radial support arms;

an annular combustion section housed inside the turbomachine casing, disposed at the outlet from the compression section and within which the air coming from the compression section is mixed with fuel in order to be burnt therein; and an annular turbine section disposed at the outlet from the combustion section and having a plurality of moving wheels that are driven in rotation by the gas coming from the combustion section, the air coming from the compression section presenting rotary motion with an angle of inclination relative to the longitudinal axis (X-X) of the turbomachine;

said turbomachine assembly further comprising wherein each of the support arms presents an angle of inclination ($\alpha$) relative to the longitudinal axis (X-X) of the turbomachine that is substantially equal to or greater than the angle of inclination of the air coming from the compression section so as to impart to the gas coming from the combustion section rotary motion with an angle of inclination that is substantially equal to or greater than the angle of inclination of the air coming from the compression section;

additional angular distribution means for determining air flow direction and formed at one or more of the following component elements of the turbomachine: a fairing of the combustion section; fuel injector systems of the combustion section; a transverse wall of the combustion section; and axial walls of the combustion section, wherein the additional angular distribution means are formed at the fairing of the combustion section, the combustion section being formed by an outer annular wall centered on the longitudinal axis (X-X) of the turbomachine, an inner annular wall coaxial with the outer wall, a transverse wall interconnecting the upstream ends of the outer and inner walls, a plurality of fuel injector systems passing through the transverse wall, and an annular fairing mounted on said transverse wall, said fairing having a plurality of openings for passing the fuel injector systems, the assembly being characterized in that each opening in the fairing has an axial wall forming an angle of inclination ($\beta$) relative to the longitudinal axis (X-X) of the turbomachine that is substantially equal to or greater than the angle of inclination of the air coming from the compression section.

4. An assembly according to claim 3, in which the additional angular distribution means are formed at the fuel injector systems of the combustion section, each of said fuel injector systems comprising a fuel injector nozzle having one end mounted on a bowl provided with radial air swirlers, the assembly being characterized in that the air swirlers of each bowl present varying permeability to the air.

5. An assembly according to claim 4, wherein the spacing between the air swirlers of each bowl varies depending on the inclination of the air coming from the combustion section.

6. An assembly according to claim 3, wherein the additional angular distribution means are formed at the fuel injector systems of the combustion section, and wherein each of said fuel injector systems presents an angle of inclination ($\gamma$) relative to the longitudinal axis (X-X) of the turbomachine that is substantially equal to or greater than the angle of inclination of the air coming from the compression section.

7. An assembly according to claim 3, wherein the additional angular distribution means are formed at the transverse wall of the combustion section, said combustion section being formed by an outer annular wall centered on the longitudinal axis (X-X) of the turbomachine, an inner annular wall coaxial with the outer wall, a transverse wall interconnecting the upstream ends of the inner and outer walls, and a plurality of fuel injector systems passing through the transverse wall, the assembly being characterized in that and wherein said transverse wall presents at each fuel injector system an angle of inclination (δ) relative to a transverse plane (P) of the turbomachine.

8. An assembly according to claim 7, wherein the additional angular distribution means are formed at the axial walls of the combustion section, said axial walls of the combustion section being provided with a plurality of orifices aligned in rows and forming channels for passing air, wherein the rows of air-passing orifices present an angle of inclination (ϵ) relative to the longitudinal axis (X-X) of the turbomachine that is substantially equal to or greater than the angle of inclination of the air coming from the compression section.

9. An assembly according to claim 8, wherein each channel presents an angle of inclination (θ1) relative to an axis (Z-Z) perpendicular to axial walls of the combustion section.

10. An assembly according to claim 9, wherein each channel is situated in a plane perpendicular to the axial walls of the combustion section presenting an angle of inclination (θ2) relative to the longitudinal axis (X-X) of the turbomachine that is substantially equal to the angle of inclination (ϵ) of the rows of orifices.

11. A turbomachine according to claim 9, wherein each channel is situated in a plane perpendicular to the axial walls of the combustion section presenting an angle of inclination (θ2') relative to the longitudinal axis (X-X) of the turbomachine that is substantially greater than the angle of inclination (ϵ) of the rows of orifices.

12. A turbomachine according to claim 11, wherein the angle of inclination (θ2') of the plane perpendicular to the axial walls of the combustion section in which the channels are situated lies in the range ϵ to ϵ+90° relative to the longitudinal axis (X-X) of the turbomachine.

13. A turbomachine including an assembly according to claim 3.

* * * * *